United States Patent [19]

Hanson

[11] Patent Number: 4,993,441

[45] Date of Patent: Feb. 19, 1991

[54] PERMANENT WAVE ROD

[76] Inventor: Luther B. Hanson, Box 162A Rte. #2, Waseca, Minn. 56093

[21] Appl. No.: 202,266

[22] Filed: Jun. 6, 1988

[51] Int. Cl.[5] ..... A45D 2/12

[52] U.S. Cl. ..... 132/226; 132/207; 132/250

[58] Field of Search ..... 132/207, 210, 222, 223, 132/226, 233, 237, 245, 248, 250, 251, 254, 261, 268, 253

[56] References Cited

U.S. PATENT DOCUMENTS

| | | | |
|---|---|---|---|
| 3,675,663 | 7/1972 | Calandra | 132/262 |
| 3,759,271 | 9/1973 | Caruso | 132/233 |
| 3,881,500 | 5/1975 | Shinbashi et al. | 132/248 |
| 3,937,233 | 2/1976 | Hook | 132/253 |
| 4,037,612 | 7/1977 | Ferrier | 132/241 |
| 4,074,964 | 2/1978 | Wells | 8/405 |
| 4,216,787 | 8/1980 | Moea | 132/250 |
| 4,249,550 | 2/1981 | Cassidy | 132/268 |
| 4,327,754 | 5/1982 | Hildreth | 132/241 |
| 4,361,159 | 11/1982 | Stefaniak | 132/251 |
| 4,465,085 | 8/1984 | Schopieray | 132/248 |
| 4,498,489 | 2/1985 | Bornhauser | 132/245 |
| 4,638,821 | 1/1987 | Smith | 132/207 |
| 4,644,965 | 2/1987 | Alexander | 132/253 |
| 4,699,160 | 10/1987 | Wiggin | 132/248 |
| 4,742,835 | 5/1988 | Boweter | 132/226 |

FOREIGN PATENT DOCUMENTS

| | | | |
|---|---|---|---|
| 2912035 | 10/1980 | Fed. Rep. of Germany | 132/226 |
| 3319048 | 11/1984 | Fed. Rep. of Germany | 132/248 |
| 0797185 | 6/1958 | United Kingdom | 132/223 |

OTHER PUBLICATIONS

Nu Wave Perm Rods advertisement.
Perm-A-Ropes advertisement.
Kickers by Gads advertisement.
Ryler Stylers advertisement.
Varioculer and Wavecurler advertisement.
A variety of rods sold by RY-AL Beauty Corp. advertisement.
Zotos Wave advertisement.

*Primary Examiner*—John J. Wilson
*Assistant Examiner*—F. LaViola
*Attorney, Agent, or Firm*—Schroeder & Siegfried

[57] ABSTRACT

A disposable permanent wave rod which is comprised of an imperforate generally cylindrically-shaped member formed of a readily wettable rigid polymeric material, wherein, due to the inherent properties of wettable polymers, greater adherence is found to exist between the wettable permanent wave rod and the wetted hair and end paper which is wrapped theraround, thereby preventing slippage of the end paper from around the permanent wave rod. Such rods may be secured to a person's head by connecting each rod to an adjacent rod through the use of rubber bands or an elongated flexible but rigid thin strip of material, which may be tacked or adhesively secured to each adjacent rod.

16 Claims, 2 Drawing Sheets

FIG. 7
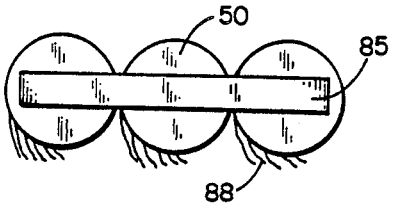
FIG. 8
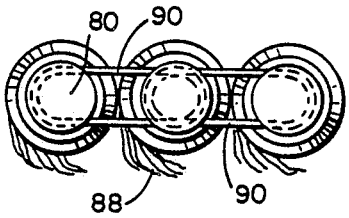
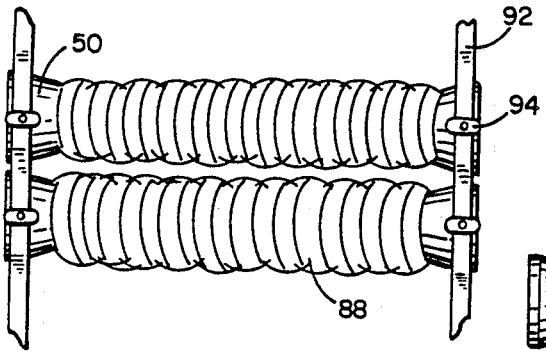
FIG. 9
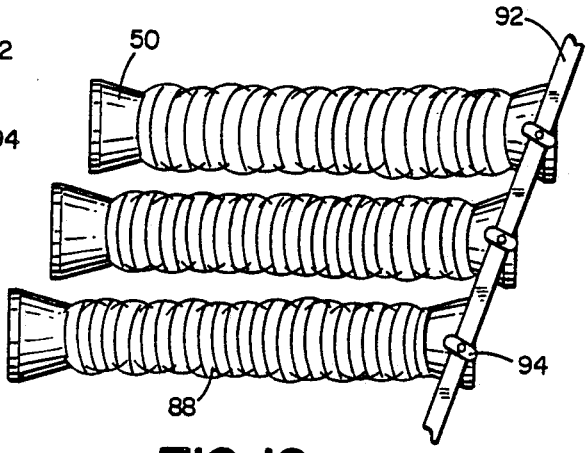
FIG. 10
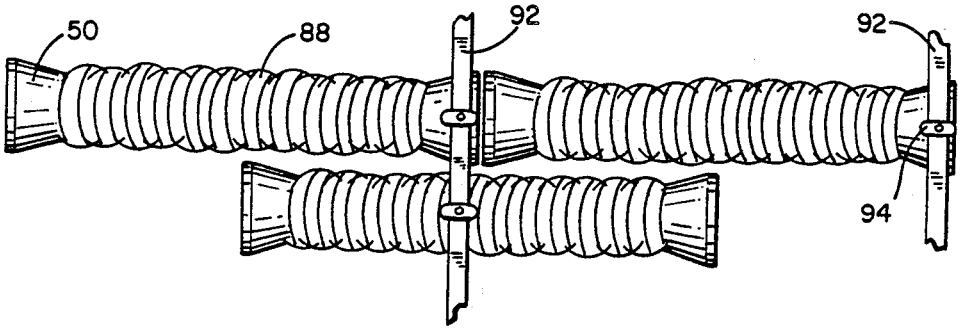
FIG. 11

PERMANENT WAVE ROD

BACKGROUND OF THE INVENTION

This invention generally relates to permanent wave rods which are used by hairdressers and the like during the application of a permanent solution to a person's hair. More particularly, this invention relates to the problem of hair slippage from around a permanent wave rod as a person giving a permanent to another attempts to roll the hair around the rod.

A conventional-type permanent wave rod is generally made of a rigid, non-porous and non-wettable cylindrically shaped plastic member (conventionally polyethylene) which is designed to be re-used from permanent to permanent. Also, such a conventional-type permanent wave rod generally has an axial bore therethrough and radially extending perforations through its outer circumferential surface which communicate with the bore therethrough.

The theory behind such a construction is that the hairdresser is supposed to inject a permanent wave solution into the central axial bore of the permanent wave rod which will then dispense through the perforations in the same and flow into the hair wrapped therearound. However, for all practical purposes, most hairdressers do not apply the permanent wave solution in such a manner as it is costly and time consuming. Rather, the hairdresser will simply apply the permanent wave solution to the hair directly from the outside of the permanent wave rod.

A large difficulty involved in giving a permanent is the actual rolling of the hair around the permanent wave rod itself. In order to facilitate winding the ends of the hair around the permanent wave rod, a special type of paper known as end paper is wrapped around the ends of the hair to hold them flatly together. This end paper has the characteristic of having a high tensile strength even when wetted so that tearing of the same will not occur as the hair and end paper are wrapped around the permanent wave rod. However, slippage between the end paper and the permanent wave rod often occurs making it very difficult and time consuming for the hairdresser since numerous wrappings around such wave rods are normally needed as a direct result of such slippage. I have found that one of the major causes of such slippage is due to the fact that conventional permanent wave rods have generally been made of a non-wettable material or have a water-resistant outer coating. Consequently, the end result is that the hairdresser may have to re-roll the entire permanent or portions thereof because the hair and end paper around a particular wave rod slipped and loosened, thereby causing an inconsistency in the tightness of the curls created.

Wettability is generally defined as the degree of which a solid may be wetted. In other words, wettability generally describes the degree to which a solid attracts or repels a liquid. The criterion generally employed to determine the wettability of a substance is to look at the contact angle between the solid and liquid (measured through the liquid) at a point where the outer surface of the liquid and the solid meet. If this angle is greater than 90°, the solid is considered relatively non-wettable, and the liquid will tend to ball up and roll off the solid surface. On the other hand, when the contact angle is less than 90° the solid is considered wettable, and the liquid will tend to spread out over the solid. In sum, there is a greater attraction between wettable solids and liquids.

Generally, many factors are present which determine whether a particular material is wettable. However, even the experts in the field of Materials Engineering apparently disagree as to which factors are the most important ones to consider. One factor usually considered is the relative surface tension of a material, but this factor is not the exclusive factor to be considered. For example, polyethylene and polystyrene have nearly equal surface tensions, 31 vs. 33 dynes/em. Nevertheless, I have discovered that polystyrene is readily wettable, whereas polyethylene repels water and does not wet well at all. Thus, in this case, it appears that the critical surface tension of the materials is not the primary factor of importance.

It has been speculated that, due to the marked differences between the respective surfaces of polyethylene and polystyrene, and the fact that water acts somewhat as an adhesive, that these factors may be more significant in determining the reason for wettability in this case. As water displaces air between the interface of two materials, such as end paper and expanded polystyrene, the water acts as an adhesive. However, if the surface repels water, as polyethylene does, then I believe that there is less displacement of air by water, and consequently less adhesive effect by the water at the interface of the two materials.

In any event, and for whatever reason, I have discovered that the use of expanded polystyrene in the manufacture of permanent wave rods provides for greater adherence between the end paper and the permanent wave rods. I believe that the concept of wettability may be why conventional permanent wave rods have difficulty with slippage problems, since most conventional permanent wave rods are made of a material which is relatively non-wettable, such as polypropylene or polyethylene.

Various solutions to the problem have been implemented in the past in an attempt to prevent the slippage of the end paper from around the wave rod, the most common approach being to form such conventional-type wave rods with a multitude of tiny nodules protruding radially outwards from the surface of the rods so as to provide a better grip on the end paper. Nevertheless, this means of preventing slippage has not been successful in that slippage continues to occur, thereby causing increased time involved with giving a permanent to another person, as well as the higher cost involved because of the increased time spent for redoing those portions of the permanent which did not result in as tight of a curl as desired.

Another problem with the conventional-type permanent wave rod stems from the fact that it must be reused from person to person, and from permanent to permanent, in order to be cost effective. Because the conventional-type permanent wave rods are reused, they must be cleaned and disinfected between each permanent given so as to facilitate a sanitary working area. In fact, beauty salons and the like are commonly subjected to periodic inspections by government health officials for cleanliness of their tools which are used in hairdressing. Re-use of the conventional-type permanent wave rods also means that such permanent wave rods have to be stored between uses in a sanitary place.

Because of the problems inherent with the conventional-type permanent wave rods, there has been a long felt need for a permanent wave rod which can be inexpensively made and disposable after each permanent, thereby eliminating the necessary sanitization which is required with the conventional-type permanent wave rods. Also, a substantial need has been felt by the industry for a permanent wave rod that will prevent slippage of the end paper, and consequently the hair wrapped therein, from around the wave rod's circumferential surface.

I have found that the present invention solves both of these problems related to the use of conventional-type permanent wave rods, and offers other marked advantages as well, which are clear improvements over the prior art.

SUMMARY OF THE INVENTION

As stated above, the invention herein is related to solving the problems of hair slippage and cleanliness involved with the conventional-type permanent wave rods. The improved permanent wave rod is an imperforate elongated rod which is generally cylindrical in shape and is formed of a generally wettable rigid polymeric material. Because of the inherent properties of wettable polymers, the adherence of the end paper to the improved permanent wave rod is markedly increased, thereby eliminating problems of slippage caused by the use of non-wettable conventional-type permanent wave rods.

Furthermore, because the adherence of the end paper to the improved permanent wave rod is increased due to the inherent properties of the material of which it is formed, unlike conventional permanent wave rods, no external retaining means is required to secure the hair around the rod. Thus, the improved permanent wave rod is constructed to be imperforate for ease of manufacturing, thereby resulting in a greatly decreased cost of manufacturing, and further allowing the rod to be of a disposable nature.

The end portions of the improved permanent wave rod may be constructed to have a larger diameter than the mid portion of the same. By so doing, I gain added assurance that the sections of hair which are wrapped around the permanent wave rod will not edge their way off the ends of the rod. Further assurance that no slippage of the end paper and hair will occur in either the axial or the circumferential direction can be gained by making the outer surface of the permanent wave rod textured with circumferentially and axially extending slits. However, it is reiterated that such texturing of the rods' surface is not necessary for the proper function of the rods.

I find that the improved construction of the permanent wave rod also has other advantages over the prior art. First of all, because of the greater adherence between the improved permanent wave rod and the end paper, much time is saved in wrapping the sections of hair around the rods because no slippage is experienced between the end paper and the rod itself. Also, because less slippage occurs when the improved permanent wave rod is used, I find that the resulting permanent is much more uniform, thereby avoiding having to re-roll portions of the permanent that didn't take. Time is also saved in cleaning the permanent wave rods in that, unlike the conventional-type rods, the improved permanent wave rods are simply thrown away after use. Moreover, the cost and space of storing the equipment used for cleaning the conventional-type permanent wave rods are saved by using the improved disposable permanent wave rod.

I find that because of the increased adherence of the end paper to the permanent wave rod which is due to the physical properties inherent with the material of which it is formed (preferably expanded polystyrene), there is no need to mold the permanent wave rod with extra radially outward extending nodules on the surface thereof, as is done with most conventional-type permanent wave rods to increase the grip of such rods on the end paper. Furthermore, there is also no need, when using the improved permanent wave rod, for any extra hair retaining means to hold the hair secure to the surface of the permanent wave rod, such as elastic bands or clamping devices which extend from one end of the rod to the other. The result is a much less costly product to manufacture. It should be noted, however, that such features as textured surfaces and extra retaining means may also be provided with the improved permanent wave rod, but are not necessary to the proper function of the rods, as is discussed below in detail.

I find that another advantage of the improved permanent wave rod is that use of the device without any extra retaining means for securing the hair around the rod prevents kinking and breaking of the hair strands, which is commonly caused when an extra retaining means is used. Also, because the improved permanent wave rod is made of an expanded polystyrene, the weight of the rod is much less than the conventional-type permanent wave rods. Consequently, the improved permanent wave rods are much more comfortable to wear while the permanent wave solution is applied and setting.

The improved construction of such permanent wave rods also gives the hairdresser flexibility in securing such rods in place upon a person's head. Conventionally, each rod is held in place separately by an external retaining means which secures the hair to the roller and, consequently, the roller to the person's head. With my improved permanent wave rod, the hairdresser may secure a plurality of such rods together, and the respective adherence characteristic of each improved permanent wave rod maintains the entire set of such rods in a secure position on the person's head.

Such methods of securing the rods together include, but are not limited to, adhesively securing an elongated relatively rigid but flexible strip of material, such as a Styrofoam backed tape, across each rod in a set of such rods, thereby holding the plurality of improved permanent wave rods securely together in a relatively fixed position on the person's head.

Another method involves the use of rubber bands which engage an outwardly extending post on each end of each improved permanent wave rod and extends between adjacent rods to securely hold adjacent rods together in a relatively fixed position.

Because my improved permanent wave rods are preferably made of a readily pierceable material, such as expanded polystyrene, such rods may also be secured together by tacking an elongated strip of relatively rigid but flexible material between a plurality of such rods, thereby securing each rod in a relatively fixed position to each adjacent rod in that set.

As can be seen, my improvements made in the formation of the improved permanent wave rod provides great flexibility of use for the hairdresser at a much lower cost.

BRIEF DESCRIPTION OF THE DRAWINGS

FIG. 7 is an end view of a partial set of improved permanent wave rods after being rolled with sections of hair therearound and having an adhesive retaining means for holding the rods securely together.

FIG. 8 is an end view of another partial set of improved permanent wave rods after being rolled with sections of hair therearound and having ends configured as those shown in FIG. 6, and being connected together by elastic bands at their ends.

FIG. 9 is a top plan view of a partial set of improved permanent wave rods after being rolled with hair therearound and showing another alternative method of securing the rods together.

FIG. 10 is a top plan view of another partial set of improved permanent wave rods after being rolled with hair therearound and showing how such rods may be staggered when connected using the means first shown in FIG. 9.

FIG. 11 is a top plan view of another partial set of randomly placed improved permanent wave rods which shows how the retaining means first shown in FIG. 9 can be used to secure such randomly placed rods together.

DETAILED DESCRIPTION OF THE INVENTION

In order to better describe the advantages and improvements of the invention disclosed herein over the prior art, a brief discussion focusing on the construction of the conventional permanent wave rods will follow, and will clearly show the difficulties related with such devices.

Figure 1:
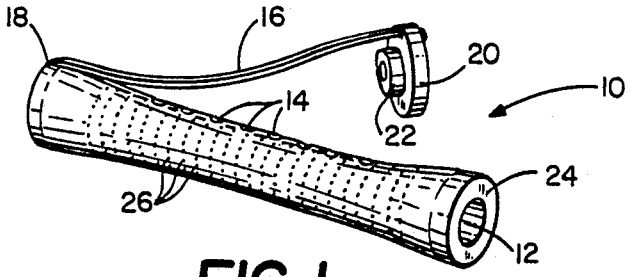
FIG. 1 (PRIOR ART)
FIG. 1 is a perspective view of an exemplary prior art permanent wave rod which is formed of polyethylene, and shows the central bore, elastic retaining means, and numerous outwardly extending nodules which are typical of prior art rods.

Shown in FIG. 1 is a conventional-type permanent wave rod 10 which is generally formed of a rigid non-wettable material such as polypropylene or polyethylene. Conventional type permanent wave rods as shown in FIG. 1 have historically had numerous problems with slippage of the end paper and hair from around the body of the rod 10 as a direct result of forming such rods from a non-wettable material which tends to repel the wetted end paper rather than adhere to it.

The conventional-type permanent wave rod 10 generally has a central axial bore 12 extending therethrough, and a plurality of radially extending perforations 14 which extend through the body of the rod to communicate with central bore 12. On one end of the conventional rod 10 an external retaining means 16 is connected (such as at point 18). The other end of the retaining means 16 carries a connector member 20 which has a plug portion 22 which is designed to telescopically engage the central axial bore 12 of the conventional type rod at its opposite end (as shown at point 24). It can also be seen from FIG. 1 that the conventional-type permanent wave rod 10 generally has a multitude of tiny nodules 26 which extend radially outward from the surface of the permanent wave rod 10, and are designed to create a rougher surface so that the end paper which is wrapped therearound will not tend to slip as much.

As can be seen from the construction of the permanent wave rod 10 shown in FIG. 1, in order to form such a rod, a rather complicated mold is required which will provide for the formation of the central axial bore 12, radial perforations 14, as well as the multitude of tiny outwardly extending nodules 26 which are needed to provide greater adherence between the end paper and the non-wettable conventional-type permanent wave rod 10.

Furthermore, a separate molded connector member 20 must be made which requires another separate mold. The clear and obvious result of the difficulty in manufacturing such items is an increased cost of manufacturing the same. Consequently, the increased cost of manufacturing dictates that such conventional-type permanent wave rods 10 must be reusable in order to make them cost effective. As indicated above, the fact that such conventional-type permanent wave rods 10 must be reusable in order to make them cost effective, such rods are required to meet industry standards for disinfection between subsequent uses of such rods, which further increases the cost of using such rods.

As shown in FIG. 1, conventional-type permanent wave rods 10 are constructed with a multitude of tiny nodules 26 which are designed to grip the end paper as it is rolled therearound. Also, each conventional-type permanent wave rod 10 carries an additional external retaining means 16 which is designed to apply pressure against the hair which is wrapped therearound so as to provide further adherence of the end paper around the same, and to secure the rod in a relatively fixed position after it is rolled. The mere fact that such drastic measures have been taken in order to provide greater adherence of the end paper to the conventional permanent wave rod 10 is evidence in itself of the great difficulties hairdressers have had in the past due to the slippage of end paper, and consequently the loosening of hair curls from around the non-wettable surface of the conventional-type permanent wave rods 10.

In use, the end paper is wrapped around the tips of the wetted hair strands which are to be rolled around the conventional-type permanent wave rod 10. Consequently, the end paper also becomes wetted as it absorbs the moisture from the wetted strands of hair. To begin rolling the hair around the conventional-type permanent wave rod 10, the end paper which contains the tips of hair is placed against the outer body surface of the rod 10, and is thereafter wound around the same.

In order for an effective curl to be made with such a conventional-type permanent wave rod 10, it is necessary that the end paper be securely anchored to the body of the same. Because of the difficulties with slippage which have been historically present with the conventional type permanent wave rods 10 that are constructed of a non-wettable material, the tiny nodules as shown in FIG. 1 have been used to provide greater adherence of the end paper to the rod 10. However, this means of anchoring the end paper has not been adequately effective and has caused hairdressers substantial losses of time and money as a result of having to re-roll entire permanents or portions thereof in order to satisfy customers.

As indicated above, conventional-type permanent wave rods 10 also need an additional external retaining means which is used to apply greater pressure against the sections of hair which are rolled around the rod and to hold the rod in place after being rolled. The added pressure against the hair is intended to help prevent further slippage of the hair from around the permanent wave rod. However, this method of anchoring the hair to the permanent wave rod has not been completely effective in preventing slippage and causes kinks in the person's hair which weakens same.

The central axial bore 12 through the conventional-type permanent wave rod 10, and the radial perforations therein, are designed to allow the permanent wave solution, which is to be injected into the central bore of the permanent wave rod 10, to flow through the perforations 14, thereby soaking into the hair which has been wrapped therearound. As indicated above, however, as a practical matter, most hairdressers do not follow this technique of applying the permanent wave solution. Rather, most hairdressers apply the permanent wave solution from the outside of the permanent wave rod.

Figure 2:
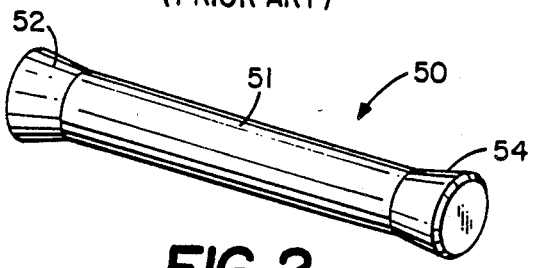
FIG. 2 is a perspective view of one alternative embodiment of my improved permanent wave rod.

My improved permanent wave rod 50 is shown in FIG. 2 and is comprised of an elongated imperforate cylindrical member 51 which is preferably formed of a rigid expanded polystyrene. I have discovered that because of the inherent characteristics of the expanded polystyrene, the material is readily wettable in that when liquid is applied thereto, the liquid tends to spread out over the surface rather than ball up and run off the surface of the rod. I believe it is this very feature, the wettability of the material from which my permanent wave rod 50 is made of, which causes the wetted end paper (88 (see FIG. 6) to securely adhere to the surface of the improved permanent wave rod 50, thereby preventing any slippage of the same and consequently resulting in consistently rolled curls which are tight and do not require any re-rolling.

I believe, as mentioned earlier, that the increased attraction between a wettable solid such as expanded polystyrene, and a liquid or wetted substance applied thereto causes greater adherence between the wetted substance (in this case the wetted end paper) and the solid (in this case the permanent wave rod). I have found many advantages are present in the improved permanent wave rod 50 which are clearly not present in the conventional-type permanent wave rod 10 shown in FIG. 1.

To begin, the cost of manufacturing my improved permanent wave rod 50 is much less than the conventional type permanent wave rod 10. As shown in FIG. 2, the construction of my improved permanent wave rod 50 has a relatively smooth surface. Indeed, it appears that it is the relatively smooth surface which promotes adherence between the wetted end paper and the improved permanent wave rod 50, since the greater the surface area of the wettable permanent wave rod 50 that the end paper contacts, the greater the adherence appears to be. The relatively smooth surface of my improved permanent wave rod 50 appears to allow for maximum surface contact by the end paper. If outwardly extending nodules were added to the surface of the improved permanent wave rod 50, similar to those carried by the conventional type permanent wave rod 10, the effectiveness of the adherence to the body of the permanent wave rod would be substantially reduced.

Thus, such nodules are not needed on my improved permanent wave rod and the mold needed to make my improved permanent wave rod 50 is less complicated and less costly than the mold for conventional rods. Furthermore, my improved permanent wave rod 50, as shown in FIG. 2, is imperforate, and thus, the mold for making the same is further simplified, thereby reducing the cost of manufacturing the improved permanent wave rod 50 even further. Also, because expanded polystyrene may be used as the material for forming the improved permanent wave rod 50, the material costs involved in making such a rod are reduced substantially.

The end result is that I find I can manufacture the improved permanent wave rod 50 at a substantially lower cost, thereby making such rods 50 disposable. The cost of manufacturing my improved rods 50 do not dictate that such permanent wave rods 50 must be reused in order to be cost effective and hence they are disposable. Furthermore, by using the disposable permanent wave rods, no disinfection requirements need be met, since my improved permanent wave rods do not need to be cleaned or stored in a sanitary area. When the hairdresser is finished using my permanent wave rods 50, the hairdresser simply throws the rods in the trash can.

In use, the wetted end paper is wrapped around the tips of the hair and thereafter placed against the surface of my improved permanent wave rod 50. I believe that the relative wettability of the improved permanent wave rod 50 attracts, rather than repels, the wetted end paper, thereby effectively and securely anchoring the end paper to the body of the permanent wave rod. Consequently, outwardly protruding nodules which are necessary when using conventional type permanent wave rods 10 are not necessary to securely anchor the end paper on the body of the improved permanent wave rod 50. With my improved permanent wave rod 50, it appears that the adherence is found in the relative attraction between the wetted end paper and the wettable surface of the rod. Consequently, no time is lost for having to re-roll individual curls since no slippage occurs between the end paper and the improved permanent wave rod 50 as the hair is wound around the rod.

The ends of my improved permanent wave rod 50 preferably radiate outwardly so as to have a greater diameter at each of the ends of the rod 50 than at the middle portion. By having ends 52 and 54 which are diametrically larger than the middle portion of the improved permanent wave rod 50, the hair which is wrapped around the improved permanent wave rod is prevented from edging laterally off the ends of the rod when the hair is rolled therearound.

Another important advantage of my improved permanent wave rod 50 is that the person receiving the permanent may relax in comfort while the permanent wave solution sets in their hair because the expanded polystyrene, of which my improved permanent wave rods 50 are preferably formed, is extremely light weight. In fact, I have found that my improved permanent wave rod, which is made of expanded polystyrene, is approximately 6–7 times less in weight than conventional-type wave rods.

Figure 3:
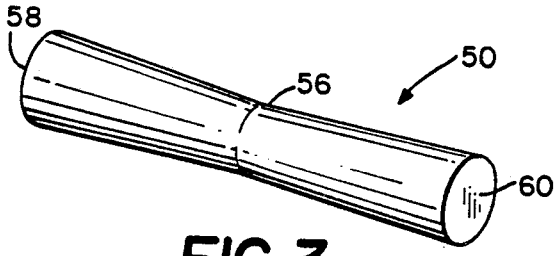
FIG. 3 is a perspective view of another alternative embodiment of my improved permanent wave rod showing a gradual increase in the diameter of the rod toward the rod's ends.

Shown in FIG. 3 is an alternate configuration of my improved permanent wave rod 50 wherein the diameter of the rod increases steadily from the mid portion 56 of the same to each end 58 and 60 thereof. Again, such a construction prevents the hair which is wrapped therearound from edging off the ends of the improved permanent wave rod.

Figure 4:
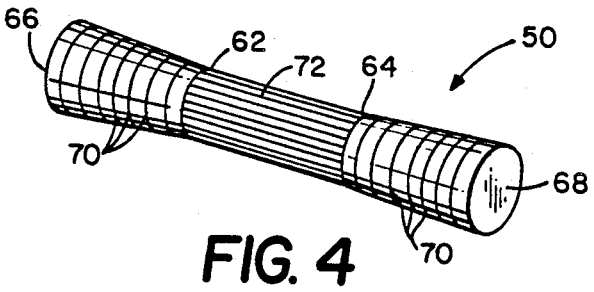
FIG. 4 shows a perspective view of another alternative embodiment of my improved permanent wave rod including circumferentially and axially extending slits therein.

FIG. 4 shows another alternate configuration of my improved permanent wave rod 50 wherein the diameter of the same increases steadily from points adjacent the midpoint (shown at points 62 and 64) to the ends 66 and 68 of the rod, respectively. Also, axially spaced circumferentially extending slits 70 have been provided at the end portions of the rod in order to increase the retention of the liquids around the surface of the improved permanent wave rod 50. Such slits 70 also provide a somewhat textured surface to further prevent strands of hair from edging laterally off the ends of the rod. Similarly, circumferentially spaced and axially extending slits 72 have been provided around the mid portion of the improved permanent wave rod 50 for the same reasons. It will be noted, however, that such slits are not necessary for effective operation of my improved permanent wave rod 50.

Figure 5:
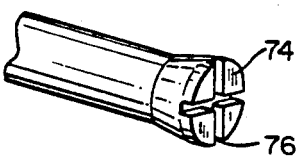
FIG. 5 is a partial perspective view of one alternative end of my improved permanent wave rod.

FIG. 5 shows another alternate form of my improved permanent wave rod 50 wherein the outer face 74 of each end of the rod has at least one transverse slit 76 extending thereacross. Such slits on each end of an improved permanent wave rod 50 are designed to facilitate the addition of an external retaining member (not shown), such as a rubber band, which may extend laterally across the length of the permanent wave rod and may be received in the slots cut in the end faces of the same. Again, it will be noted that such an external retaining means is not necessary to the proper function of the invention disclosed herein, but nevertheless has been added to show the versatility of the improved permanent wave rod 50 and the features that may be included therewith, if so desired. The use of my improved permanent wave rod 50 without such an external retaining means is preferred since the use of such an external retaining means often causes undesirable kinks in a person's hair.

Figure 6:
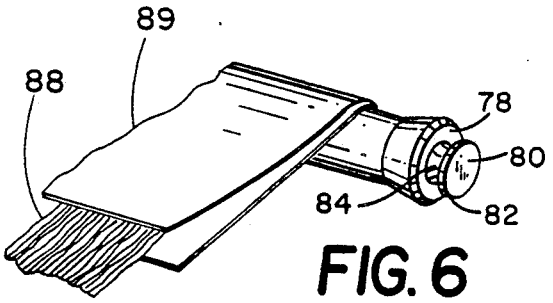
FIG. 6 is a partial perspective view of another alternative end of my improved permanent wave rod.

Shown in FIG. 6 is another alternative form of my improved permanent wave rod 50 wherein the outer face 78 of at least one end of the rod carries a post member 80 which extends axially outward therefrom and is constructed to engage and retain an external retaining means (not shown) similar to that described in FIG. 5. The post, as shown in FIG. 6, is constructed with a diametrically expanded end portion 82 and a recessed middle portion 84 which act to hold the external retaining means from slipping off the end of the post.

It should be noted that other configurations of my improved permanent wave rod may be available for attaching an external retaining means, and that the disclosures shown in the accompanying drawings are illustrative only.

Because of the improved construction of the permanent wave rod 50 which is formed from a generally wettable material, such as expanded polystyrene, alternate methods are available for securing such rods 50 in a relatively fixed position after the hair has been rolled thereon. Such methods include various means for fastening the improved permanent wave rods 50 together as a set to provide stability: One possible configuration, as shown in FIG. 7, is to use a Styrofoam-backed tape 85. In use, after temporarily securing the first rod rolled with hair 88 in place with a hair clip or other fastener, the second and consecutively rolled rods thereafter may be secured together at their ends by adhesively securing the relatively rigid but flexible Styrofoam-backed tape 85 along the end faces of each rod 50 so as to fixedly secure the consecutively rolled rods together as a set. The Styrofoam-backed tape may be applied across either one or both ends of the rods.

Alternatively, using a configuration of my improved permanent wave rod 50 similar to that shown in FIG. 6, consecutively rolled permanent wave rods may be secured together through the use of rubber bands. As shown in FIG. 6 and FIG. 8, the ends of the permanent wave rods 50 are designed to have a outwardly extending post 80 with a recessed middle portion 84 to accommodate and hold a rubber band therearound.

In use, after the first permanent wave rod 50 is rolled with hair 88 therearound, and clipped or tacked to temporarily hold the same in place, additional rods 50 may be rolled and securely fastened together through the use of rubber bands 90, as shown in FIG. 8. It will be noted that once the second permanent wave rod 50 is rolled and secured to the first rolled permanent wave rod 50, the means used for tacking or clipping the first permanent wave rod in place may be removed since the adjoining permanent wave rods 50 hold themselves in place without requiring further tacking. Preferably, as shown in FIG. 8, each adjacent adjoining pair of permanent wave rods is secured together at one or both ends by a separate rubber band 90.

Use of the rubber bands 90 to secure adjacent improved permanent wave rods 50 together may be supplemented by the use of the Styrofoam-backed tape 85 as shown in FIG. 7 and discussed above. Such use of the combination of rubber bands 90 and Styrofoam-backed tape 85 is particularly advantageous when giving certain style permanents such as a stacked perm, where the rods 50 are stacked on top of each other one after another. In giving such a permanent, a Styrofoam-backed tape 85 adds support to the stacked rods, thereby preventing the rods from shifting sideways or falling from their stacked position.

Another method of securing adjacent permanent wave rods to each other is shown in FIGS. 9–11, wherein it is generally shown that such rods may be tacked to each other through the use of an elongated strip of relatively rigid but flexible material 92, such as Styrofoam. As in the methods describe above, the first rod 50 is rolled with hair 88 thereround and then clipped or tacked in place. Additional rods are then rolled, and the thin strip of flexible material 92, such as Styrofoam, is connected between the ends of each adjacent permanent wave rod. Because the improved permanent wave rod 50 is preferably made of expanded polystyrene, it is readily pierceable and the thin strip of flexible material 92 used to connect adjacent rods may be easily tacked to the ends of each adjacent rod through the use of a tack 94 or some other mean which would be capable of piercing the rods 50. Again, the thin securing strips 92 may be tacked to adjacent permanent wave rods along one end, both ends, or anywhere along the body thereof, if so desired.

FIG. 9 shows a pair of adjacent permanent wave rods 50 which have been connected through the use of a thin strip of flexible material 92, such as Styrofoam. The strip 92 has been tacked between both ends of adjacent rods FIG. 10, on the other hand, shows a set of permanent wave rods 50 which are in staggered placement and are tacked together at one end through the use of a thin strip of flexible material 92, such as Styrofoam, and tacks 94 connecting the thin strip 92 to each individual rod.

FIG. 11 shows a set of permanent wave rods 50 randomly placed, and shows that the thin strip of flexible material 92, may be tacked between adjacent permanent wave rods 50 at any point along the surface of such rods.

It will also be noted that my improved permanent wave rod may be easily constructed in a similar shape to the prior art permanent wave rods 10, if desired. Thus, it is obvious that the improved permanent wave rod as shown in FIGS. 2–6 above could also be secured together in a manner similar to that in which prior art wave rods have heretofore been interconnected.

It should be remembered that when considering this invention that the present disclosure is illustrative only, and the scope of the invention should be determined from the appended claims.

I claim:

1. A disposable permanent wave device, comprising:

(a) an elongated imperforate generally cylindrically shaped member having end portions with a middle portion disposed therebetween and being formed of a relatively readily wettable expanded polystyrene and being constructed and arranged to receive and have rolled thereon a section of hair around its cylindrical body and to hold the same securely while the permanent wave solution is applied; and (b) a section of end paper folded over the ends of the section of hair and wrapped around said cylindrically shaped member, thereby adhering said end paper to said cylindrically shaped member when wetted and rolled therearound.

2. The structure defined in claim 1, wherein each end portion of said generally cylindrically shaped member has a slightly enlarged diameter.

3. The structure defined in claim 1, wherein each end portion of said cylindrical member flares radially outward, thereby creating a major diameter adjacent each end

4. The structure defined in claim 1, wherein said generally cylindrically shaped member has a continuously increasing diameter from the middle portion of said member to each end of said member.

5. The structure defined in claim 1, wherein the middle portion of said cylindrically shaped member has axially extending slits which are circumferentially spaced and disposed therearound, and the end portions of said cylindrically shaped member being of greater diameter than the middle portion of the same and being tapered towards the middle portion, the end portions of said cylindrical member having circumferential slits therearound which are axially spaced from the middle portion to the ends of said member.

6. The structure defined in claim 1, wherein each end of said cylindrical member has at least one groove cut therein.

7. The structure defined in claim 1, wherein each end of said cylindrical member carries an axially protruding post.

8. A disposable permanent wave rod used for rolling hair wrapped in end paper therearound so as to facilitate applying a permanent wave solution to the hair, comprising:

(a) an elongated generally cylindrically shaped member having end portions and a middle portion disposed therebetween and being formed of an imperforate readily wettable rigid polymeric material; and (b) end paper folded over the ends of the section of hair and wrapped around said cylindrically shaped member, thereby engaging and adhering said end paper to said cylindrically shaped member when wetted and wrapped around said member.

9. The structure defined in claim 8, wherein the end portions of said elongated cylindrical member have a greater diameter than the middle portion of said elongated cylindrical member.

10. The structure defined in claim 9, wherein the diameter of each end portion of said cylindrical member increases continuously from a point adjacent the midpoint of said cylindrical member to a point near each respective end of said cylindrical member, said cylindrical member having its greatest diameter near each of its ends.

11. The structure defined in claim 8, wherein the diameter of said generally cylindrically-shaped member increases gradually outwardly from its axial midpoint to each end thereof.

12. The structure defined in claim 8, wherein the middle portion of said generally cylindrically-shaped member is textured to enhance the adhesion of the end paper to said cylindrical member.

13. The structure defined in claim 8, wherein said elongated cylindrical member is textured to enhance the adhesion of the end paper to said cylindrical member thereby aiding in preventing the hair and end paper from slipping in either the axial direction or rotationally around said elongated cylindrical member.

14. The structure defined in claim 13, wherein said textured surface of said elongated cylindrical member is further comprised of elongated axial slits circumferentially spaced around the middle portion of said cylindrical member, and axially spaced and circumferentially extending slits disposed at the end portions of said generally cylindrical member.

15. A method of securing together a plurality of adjacent disposable permanent wave rods, each of which has a section of hair of a person's head wound therearound and each of which is composed of a material which is readily wettable and pierceable, comprising the steps of:

(a) applying at least one elongated thin strip of flexible but relatively rigid material across a plurality of permanent wave rods; and (b) tacking each said elongated strip to each permanent wave rod with a separate piercing tack to securely hold the rods together in a relatively fixed position.

16. A method of preparing a person's wetted hair for application of a permanent wave solution, comprising the steps of:

(a) selecting a polymeric permanent wave rod having characteristics of being readily wettable and pierceable;

(b) separating a section of the person's hair having a width of smaller dimension than the axial length of said rod;

(c) applying end paper to said section of hair;

(d) wetting said end paper and the hair to which it is applied;

(e) winding said section of hair and end paper around said rod;

(f) selecting at least one elongated relatively thin flexible, but rigid strip of material;

(g) tacking each said strip of material to said rod;

(h) temporarily securing said rod in a relatively fixed position to prevent said section of hair from becoming unwound from said rod;

(i) repeating steps (a) through (e) until the desired number of said sections of the person's hair has been wound onto said permanent wave rods, and (j) tacking each previously selected flexible strip to each selected permanent wave rod to form a continuously connected plurality of permanent wave rods relatively fixed in place to prevent said sections of hair from unwinding from said rods.

* * * * *

UNITED STATES PATENT AND TRADEMARK OFFICE

CERTIFICATE OF CORRECTION

PATENT NO. : 4,993,441

DATED : February 19, 1991

INVENTOR(S) : Luther B. Hanson

It is certified that error appears in the above-identified patent and that said Letters Patent is hereby corrected as shown below:

Column 7, line 40, delete "(88" and substitute therefor --89--.

In the Claims:

Claim 3, line 44, after "end" add --.--.

Signed and Sealed this

Thirtieth Day of June, 1992

*Attest:*

DOUGLAS B. COMER

*Attesting Officer*

*Acting Commissioner of Patents and Trademarks*